US008641234B2

(12) United States Patent
Dubé et al.

(10) Patent No.: US 8,641,234 B2
(45) Date of Patent: Feb. 4, 2014

(54) LAMPPOST HEAD ASSEMBLY WITH ADJUSTABLE LED HEAT SINK SUPPORT

(75) Inventors: Jean-Guy Dubé, St. Pie (CA); Jean Morin, Trois-Riviéres (CA); Camille Chagnon, Varennes (CA)

(73) Assignee: Groupe Ledel Inc., Varennes, Quebec (CA)

( * ) Notice: Subject to any disclaimer, the term of this patent is extended or adjusted under 35 U.S.C. 154(b) by 330 days.

(21) Appl. No.: 13/173,067

(22) Filed: Jun. 30, 2011

(65) Prior Publication Data

US 2013/0003378 A1 Jan. 3, 2013

(51) Int. Cl.
*F21V 21/14* (2006.01)

(52) U.S. Cl.
USPC ..... 362/249.07; 362/240; 362/249.1; 362/294; 362/373

(58) Field of Classification Search
USPC ..... 362/523, 545, 547, 238, 240, 249.02, 362/249.03, 249.07, 249.1, 294, 373
See application file for complete search history.

(56) References Cited

U.S. PATENT DOCUMENTS

| | | | | |
|---|---|---|---|---|
| 7,114,837 | B2 * | 10/2006 | Yagi et al. | 362/523 |
| 7,338,186 | B1 * | 3/2008 | Wu et al. | 362/294 |
| 7,404,658 | B1 * | 7/2008 | Lyons et al. | 362/542 |
| 7,686,469 | B2 | 3/2010 | Ruud et al. | |
| 7,771,087 | B2 | 8/2010 | Wilcox et al. | |
| 7,817,063 | B2 | 10/2010 | Hawkins et al. | 340/870.07 |
| 7,972,035 | B2 | 7/2011 | Boyer | |
| 8,057,082 | B2 * | 11/2011 | Seabrook | 362/547 |
| 8,070,306 | B2 * | 12/2011 | Ruud et al. | 362/101 |
| 8,092,049 | B2 | 1/2012 | Kinnune et al. | |
| 8,109,660 | B2 * | 2/2012 | Hochstein et al. | 362/373 |
| 8,123,378 | B1 * | 2/2012 | Ruberg et al. | 362/249.02 |
| 8,197,115 | B2 * | 6/2012 | Wilkinson et al. | 362/648 |
| 8,201,969 | B2 | 6/2012 | Liu et al. | |
| 8,251,552 | B2 | 8/2012 | Rooms et al. | |
| 8,414,155 | B2 * | 4/2013 | Catone et al. | 362/249.03 |
| 8,439,532 | B2 * | 5/2013 | Bertram et al. | 362/373 |
| 2007/0222581 | A1 | 9/2007 | Hawkins et al. | 340/539.1 |
| 2008/0080162 | A1 | 4/2008 | Wilcox et al. | |

(Continued)

FOREIGN PATENT DOCUMENTS

| | | |
|---|---|---|
| AU | 2007/221761 | 4/2008 |
| AU | 2008/317060 B2 | 8/2011 |

(Continued)

OTHER PUBLICATIONS

Brochure. "Lighting Mode: The Power of Light: Roadway Lights." BETALUX/Betagroup S.r.L. pp. 1-20. May 12, 2011.

(Continued)

*Primary Examiner* — Ismael Negron
(74) *Attorney, Agent, or Firm* — Roberts & Roberts, LLP

(57) ABSTRACT

A lamppost head assembly including a housing compartment having a cavity, a panel and at least one fastener. The panel has a plurality of Light Emitting Diodes (LEDs) positioned on a first surface and a heat sink positioned on a second surface opposite to the first surface. The heat sink is adapted to fit into the cavity for dissipating the panel's heat into the housing compartment. The at least one fastener maintains the panel at an angle with the housing compartment from a plurality of angle options and may optionally further maintain the heat sink into the cavity.

19 Claims, 11 Drawing Sheets

(56) References Cited

U.S. PATENT DOCUMENTS

| | | | | |
|---|---|---|---|---|
| 2008/0080188 | A1* | 4/2008 | Wang | 362/294 |
| 2008/0080196 | A1 | 4/2008 | Ruud et al. | |
| 2008/0310850 | A1 | 12/2008 | Pederson et al. | 398/135 |
| 2009/0014626 | A1 | 1/2009 | Chu et al. | 250/206 |
| 2009/0109670 | A1 | 4/2009 | Boyer | |
| 2009/0185376 | A1 | 7/2009 | Yu | 362/253 |
| 2009/0225551 | A1 | 9/2009 | Chang et al. | 362/311.06 |
| 2009/0251898 | A1 | 10/2009 | Kinnune et al. | |
| 2009/0267525 | A1 | 10/2009 | Zheng et al. | 315/159 |
| 2010/0097796 | A1 | 4/2010 | Liu et al. | |
| 2010/0118531 | A1 | 5/2010 | Montagne | 362/235 |
| 2010/0149809 | A1 | 6/2010 | Ruud et al. | |
| 2010/0188845 | A1 | 7/2010 | Rooms et al. | |
| 2010/0214782 | A1* | 8/2010 | Allegri | 362/249.07 |
| 2010/0220470 | A1 | 9/2010 | Kim | 362/231 |
| 2011/0007505 | A1 | 1/2011 | Wang | 362/235 |
| 2011/0032696 | A1 | 2/2011 | Kim et al. | 362/184 |
| 2011/0085326 | A1 | 4/2011 | Jouffrieau | 362/232 |
| 2011/0134239 | A1 | 6/2011 | Vadai et al. | |
| 2011/0249427 | A1 | 10/2011 | Rooms et al. | |
| 2012/0026737 | A1 | 2/2012 | Dinc et al. | |
| 2012/0057348 | A1 | 3/2012 | Ruud et al. | |
| 2012/0127713 | A1* | 5/2012 | Lee | 362/235 |
| 2012/0176790 | A1 | 7/2012 | Kinnune et al. | |

FOREIGN PATENT DOCUMENTS

| | | | |
|---|---|---|---|
| AU | 2011/229847 | | 8/2012 |
| CA | 2604564 | A1 | 3/2008 |
| CA | 2685323 | | 11/2008 |
| CA | 2702521 | | 4/2009 |
| CA | 2720313 | | 10/2009 |
| CA | 2782302 | | 6/2011 |
| CA | 2604564 | C | 11/2011 |
| EP | 1906081 | A1 | 4/2008 |
| EP | 2206947 | A2 | 7/2010 |
| EP | 2211086 | A2 | 7/2010 |
| EP | 1906081 | B1 | 6/2011 |
| EP | 2149009 | B1 | 7/2012 |
| IE | 20070758 | | 6/2008 |
| IE | 20070759 | | 6/2008 |
| WO | WO2008/047335 | | 4/2008 |
| WO | WO2008/140720 | | 11/2008 |
| WO | WO2009/055334 | | 4/2009 |
| WO | WO2011/067749 | | 6/2011 |
| WO | WO2011/119330 | | 9/2011 |

OTHER PUBLICATIONS

Brochure. "Evolaire: Street and Area Luminaire." Philips Hadco. pp. 1-16. May 12, 2011.

Instruction Manual. "WL Tenon Mount (HT2) Instructions", "WL Tenon Mount (HT) Instructions", "WL Wall Mount Instructions", "WL Square Pole Mount Instructions", "WL Round Pole Mount Instructions", Philips Hadco. pp. 1-5. May 12, 2011.

"Glare Necessities." By Eric Anderson, Philips Hadco. Traffic Technology International. p. 67. Jan. 2010.

* cited by examiner

LAMPPOST HEAD ASSEMBLY WITH ADJUSTABLE LED HEAT SINK SUPPORT

TECHNICAL FIELD

The present invention relates to lighting solutions and, more specifically, to adjustable Light Emitting Diode (LED)-based lighting solutions.

BACKGROUND

A light-emitting diode (LED) transfers electric energy into photons by electroluminescence. LED-based lighting solution has the advantages of being resistant to shock, have an extended lifetime under proper condition and better energy to photon ratio than incandescent solutions. A LED lighting lamp usually has higher brightness than existing incandescent lamps, but also produces narrower light beam. As such, when deploying LED-based lamps or when replacing existing incandescent lamps with LED-based lamps, properly adjusting light beams becomes a concern.

The present invention addresses the above issue.

SUMMARY

A first aspect of the present invention is directed to a lamppost head assembly comprising a housing compartment having a cavity, a panel and at least one fastener. The panel has a plurality of Light Emitting Diodes (LEDs) positioned on a first surface and a heat sink positioned on a second surface opposite to the first surface. The heat sink is adapted to fit into the cavity for dissipating the panel's heat into the housing compartment. The at least one fastener maintains the panel at an angle with the housing compartment from a plurality of angle options and maintains the heat sink into the cavity.

The angle between the panel and the housing compartment allows to determine a distance at which a light beam from the panel is projected, for instance, away from the housing compartment or from a mounting point of the housing compartment.

Optionally, the heat sink may have a continuous surface in contact with the cavity formed by a series of heat sink fins. The heat sink may also have internal fins between the continuous surface and the panel. Another option is for the cavity to have a continuous surface in contact with the heat sink, which is formed by a series of fins.

The cavity may present various shapes. For instance, the cavity may have a semicircular channel shape. The angle between the panel and the housing compartment would then provide a single rotational and directional angle. The semicircular channel shape may be positioned perpendicularly from a longitudinal axis of the housing compartment. The semicircular channel shape may be continuous or be facetted to define a plurality of surfaces (e.g., providing one way of defining the plurality of angle options). In the latter case, at least one of the plurality of surfaces may further define a semicircular shape (e.g., providing one way of defining a limited set of angle options).

The cavity may also have a hemispherical socket shape. The angle between the panel and the housing compartment would then be determined in many directions. The hemispherical socket shape may be continuous.

The lamppost head assembly may further comprise a second panel having a second plurality of Light Emitting Diodes (LEDs) positioned on a first surface of the second panel and a second heat sink positioned on a second surface of the second panel, opposite to the first surface of the second panel.

The second heat sink may be adapted to fit into the cavity for dissipating the second panel's heat into the housing compartment. The at least one fastener may optionally maintain the second panel at the same angle as the panel and maintain the heat sink into the cavity. The at least one fastener may also optionally comprise at least a first fastener that maintains the panel at the angle and a second fastener that maintains the second panel at a second angle.

The second heat sink may also be adapted to fit into a second cavity of the lamppost head assembly for dissipating the second panel's heat into the housing compartment. At least a second fastener may then be used to maintain the second panel at a second angle and maintain the second heat sink into the second cavity. The angle between the panel and the housing compartment and the second angle between the second panel and the housing compartment may be substantially equal or different.

Optionally, the second panel may also be positioned over the same heat sink as the panel instead of the second heat sink.

The heat sink may comprise an extending lip positioned at one end and a ledge positioned at the other end. The at least one fastener, in this example, would comprise a first fastener that fixes the ledge to the housing compartment and a bracket fixed to the housing compartment that holds to the heat sink lip. The height of the bracket would then determine the angle between the panel and the housing compartment.

Optionally, the panel may also rotate within a panel frame. The at least one fastener would then comprise at least a first fastener that fixes the panel frame to the housing compartment, thereby maintaining the heat sink in the cavity. In this example, as a first option, the at least one fastener may also further comprise at least a second fastener between the panel and the panel frame to maintain the angle between the panel and the housing compartment. As a second option for this example, the at least one fastener may also comprise at least a second fastener between the heat sink and the cavity that maintains the angle (e.g., through friction alone or with a series of pegs and holes or complementary shapes).

The housing compartment and the cavity may be cast in a single metallic piece, such as aluminum or aluminum alloy.

BRIEF DESCRIPTION OF THE DRAWINGS

Further features and advantages of the present invention will become apparent from the following detailed description, taken in conjunction with the annexed drawings, in which.

DETAILED DESCRIPTION

The present invention provides the exemplary advantage of directing a beam of light at a desired distance from a lamppost. The solution of the present invention is particularly useful when applied to LED-based lighting, even though it is not limited to this context. When used in the context of multiple LED panels in a single housing compartment, the solution of the present invention may also provide another exemplary advantage of allowing per-panel adjustment of the light beam. Another exemplary advantage may be provided by heat dissipation being integrated in the light beam adjustment and still allowing for conventional lamppost head assembly design or housing compartment design, which may be advantageous especially in the context of equipment replacement.

Figure 1:
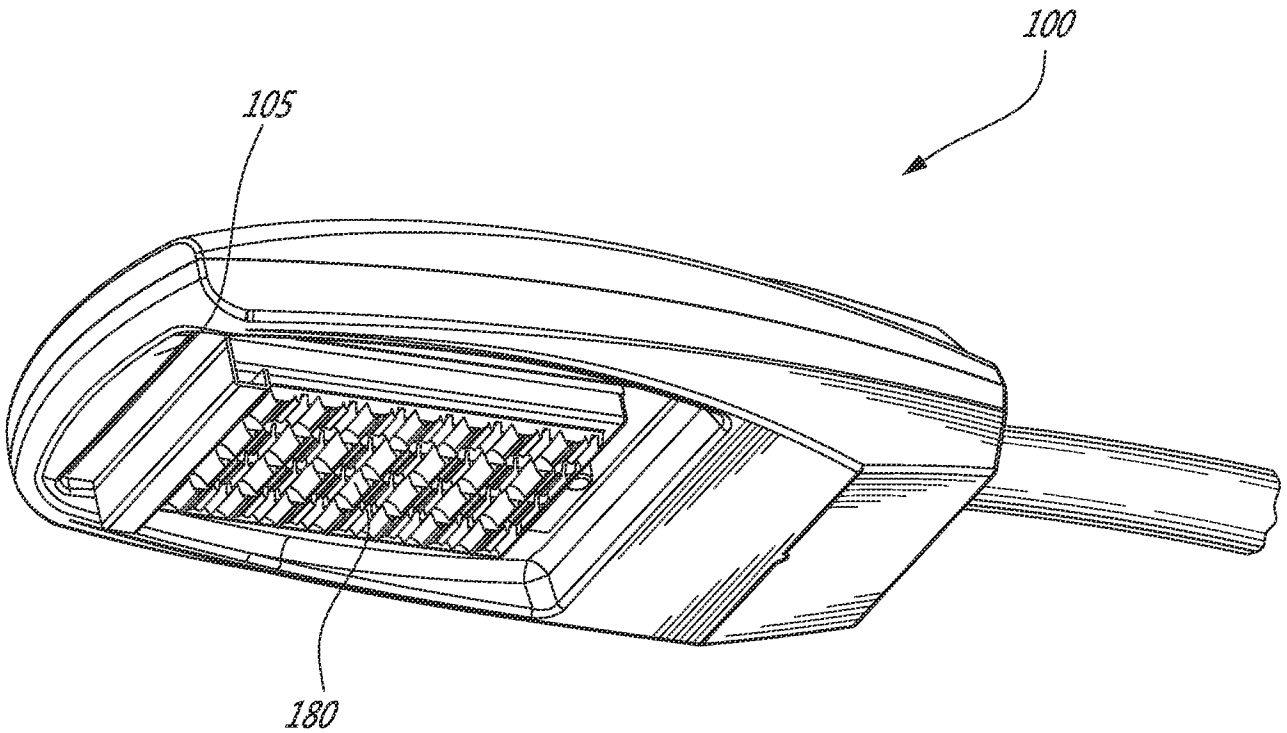
FIG. 1 is a perspective view of an exemplary lamppost head assembly in accordance with the teachings of the present invention.
Figure 2:
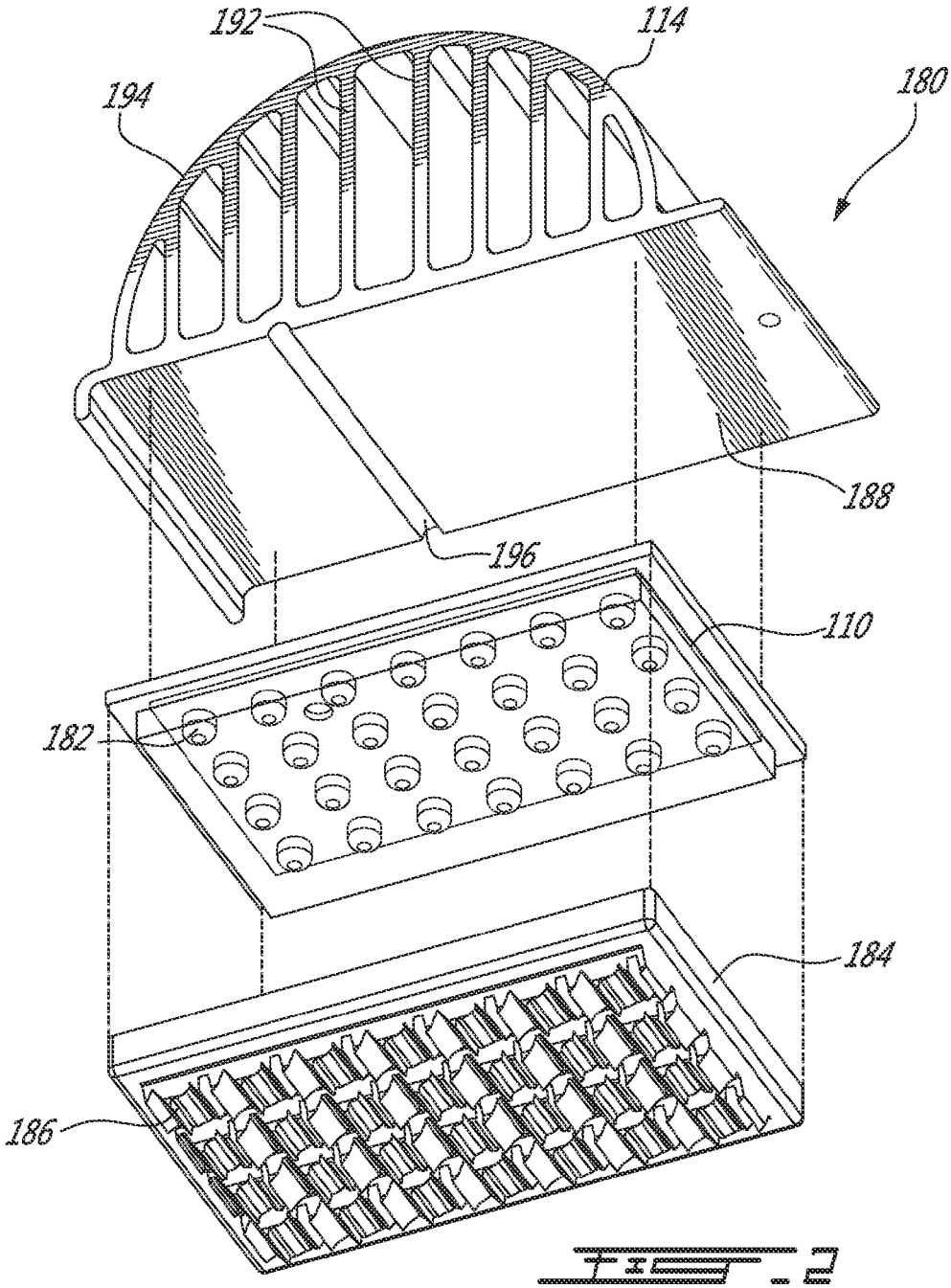
FIG. 2 is an exploded view of an exemplary lighting panel assembly in accordance with the teachings of the present invention.

Reference is now made to the drawings, in which FIG. 1 shows an exemplary perspective view of a first lamppost head assembly 100 in accordance with the teachings of the present invention. The lamppost head assembly 100 is shown with a single lighting panel assembly 180 in its housing compartment 105. Reference is concurrently made to FIG. 1 and FIG. 2, which also shows the lighting panel assembly 180. The lighting panel assembly 180 comprises a panel 110 that comprises a series of Light Emitting Diodes (LEDs) 182 positioned on one of the panel's 110 surface. Conclusive tests were made with 28 Philips LXML-PWC1-0100 LEDs.

In order to protect the LEDs, the lighting panel assembly 180 may also comprise a cover 184, which could de snapped to the panel 110 or otherwise held over the LEDs 182. One or more fixed lenses 186 may be provided over each or some of the LEDs 182, which could be useful to better control the light beam produced by the panel 110. The fixed lenses 186 may, for instance, be molded in the cover 184. The fixed lenses 186 could also be snapped of otherwise fixed to the panel 110 over the LEDs 182, which may further avoid the need for the cover 184. In presence or absence of the cover 184, the housing compartment 105 could also be covered (not shown). The exemplary cover 184 is shown in a translucent or transparent material, which may also be tinted to affect the light beam color or temperature. The cover 184 could also be made partly or completely in opaque or semi opaque material (not shown) with a translucent or transparent face or face with holes (not shown), which could further be adapted to hold the fixed lenses 186. The fixed lenses 186 do not have to all be identical.

The exemplary lighting panel assembly 180 also comprises a heat sink 114 adapted to fit onto the surface of the panel 110 opposite to the LEDs 182. The heat sink 114 has a continuous surface in thermal contact with the panel 110. Skilled person will readily recognize the different means that can be used to ensure proper heat dissipation from the panel 110 towards the heat sink 114, including, for instance, proper holding means (not shown) and a thermal compound (not shown) between the panel 110 and the heat sink 114. The heat sink 114 has a plurality of fins 192 extending from the surface 188. The fins 192 are shown extending to a continuous semi-circular surface 194. The heat sink 114 is shown with an optional groove 196, which may be used to electrically wire the panel 110. Skilled reader will readily appreciate that electrical power and other electronic components (not shown) are needed in order for the LEDs 182 to emit light within the desired parameters. The electronic components may be completely or partly provided on the panel 110 and/or within the housing compartment 105. The electrical power is delivered through wires (not shown) via the groove 196 or otherwise.

Persons skilled in the art will readily recognize that the panel 110 could comprise other LED types and/or a different number of LEDs. Likewise, the panel assembly 180 could be made with or without the cover 184. As will be shown with reference to other Figures, the shape of the heat sink 114 and the presence or shape of the surface 194 may vary depending on the shape and surface of the receiving cavity (not shown on FIG. 2). In absence of the surface 194, some or all of the fins 192 would extend from the surface 188 towards the surface of the receiving cavity, as will be shown later. As skilled reader will appreciate, the shape and surface adaptation between the receiving cavity and the heat sink 114 are meant to ensure proper heat dissipation from the panel 110 into the housing compartment 105. While it is not expected to be necessary, a thermal compound could also be used between the heat sink 114 and the receiving cavity.

Figure 3:
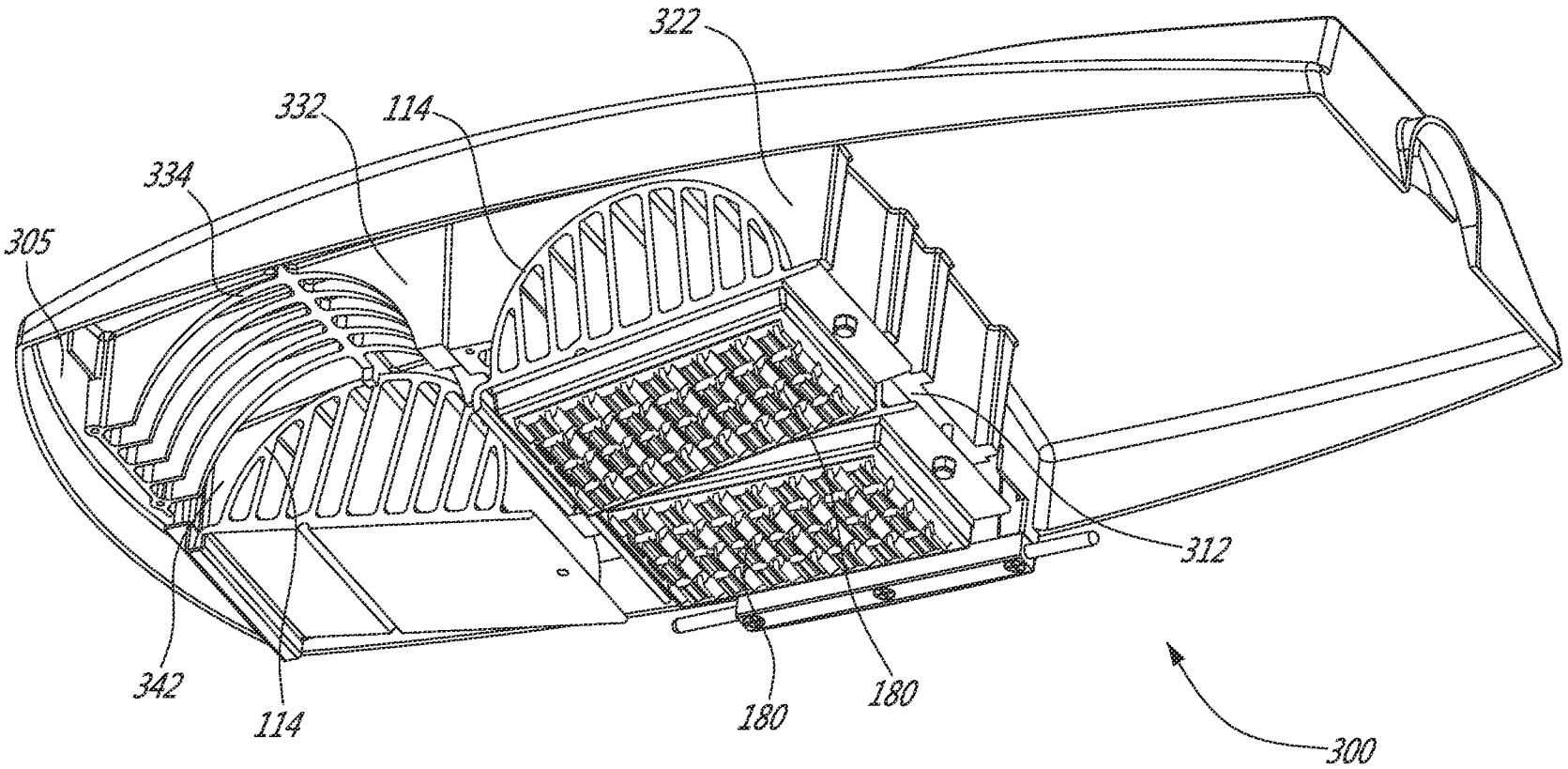
FIG. 3 is an exploded perspective view of an exemplary quad panel lamppost head assembly showing a heat sink in a semicircular channel in accordance with the teachings of the present invention.
Figure 4A:
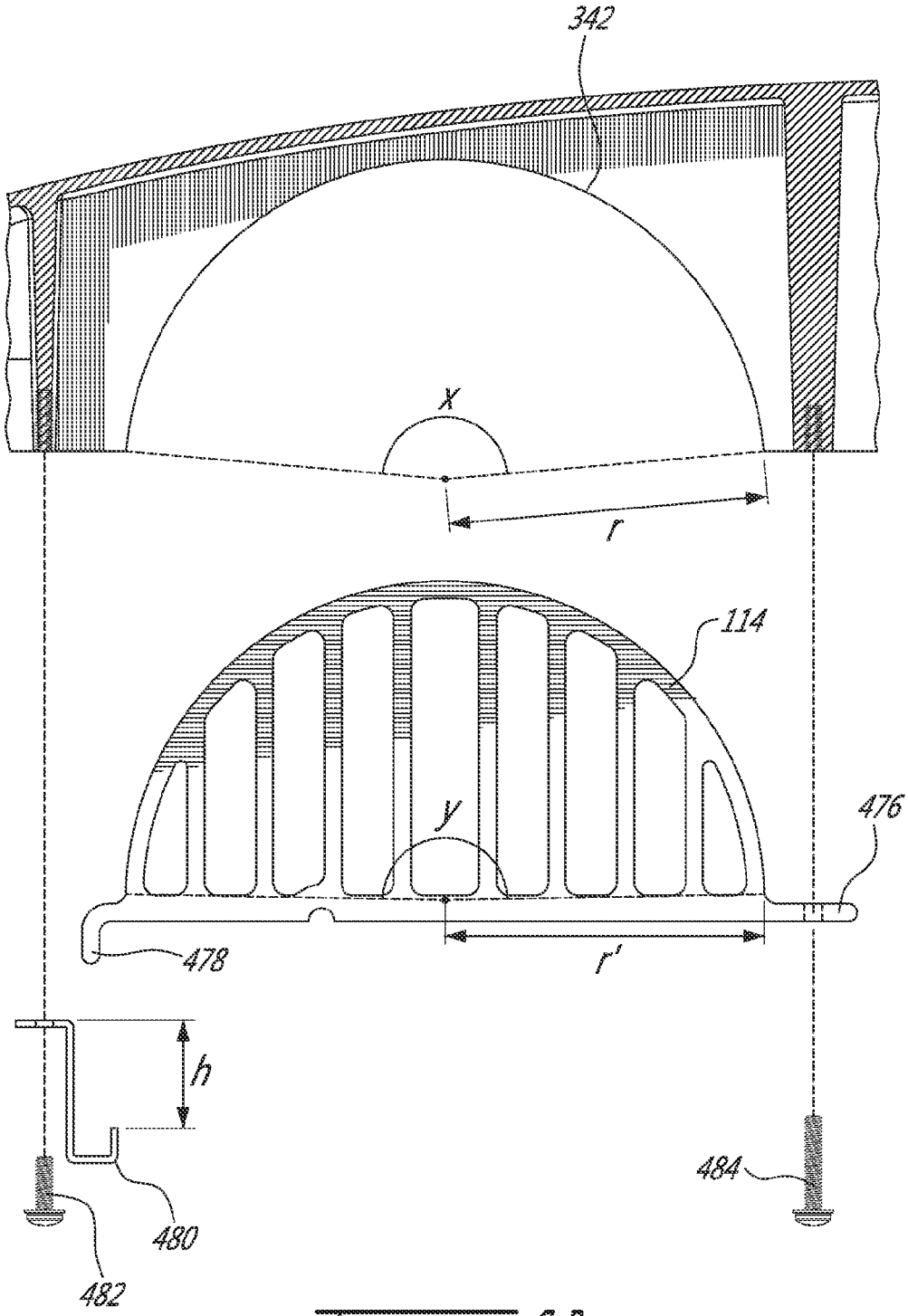
FIG. 4A, FIG. 4B, FIG. 4C and FIG. 4D herein referred to concurrently as FIG. 4 are side views of an exemplary heat sink in a cavity in accordance with the teachings of the present invention.
Figure 4B:
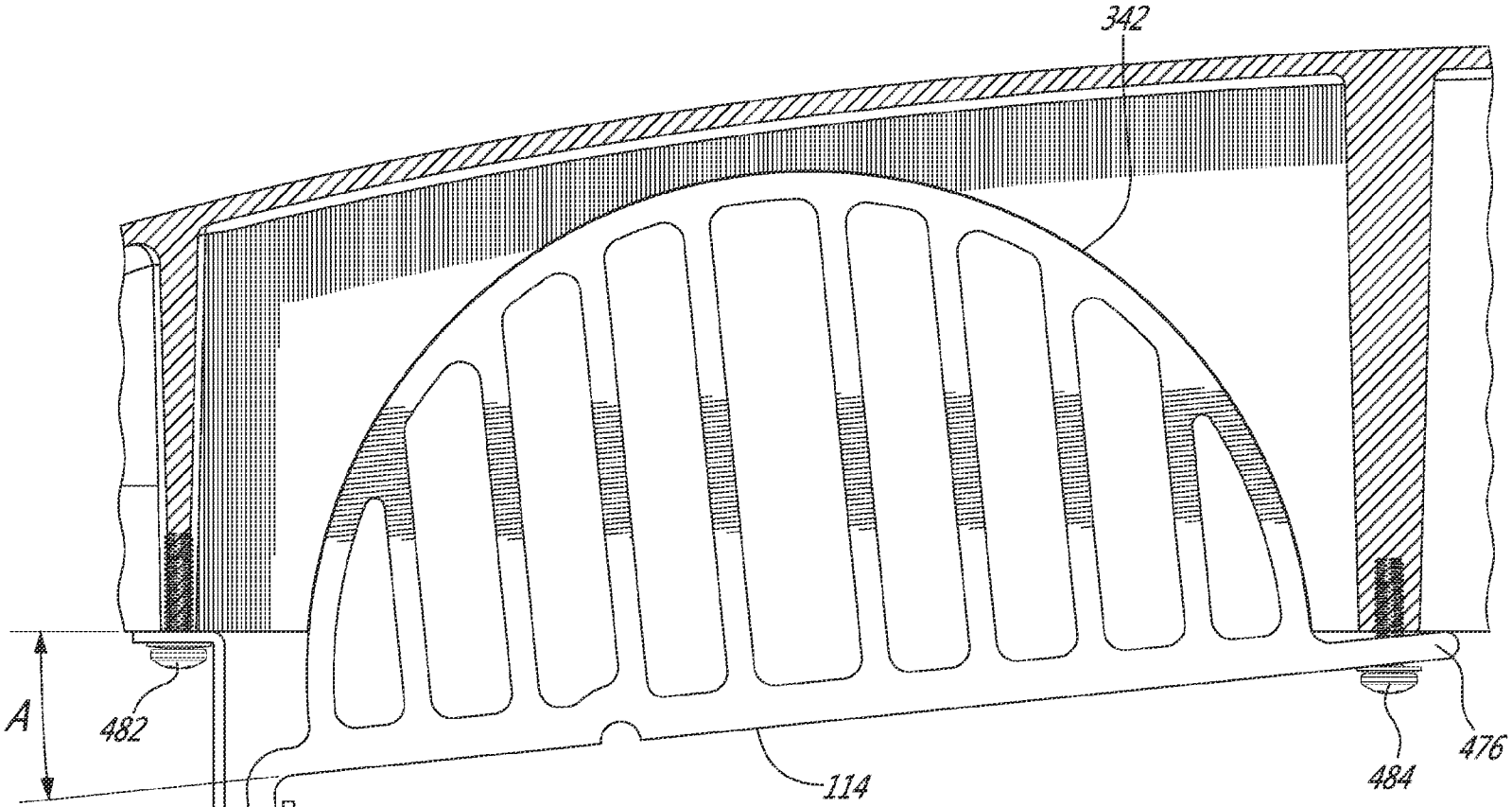
Figure 4C:
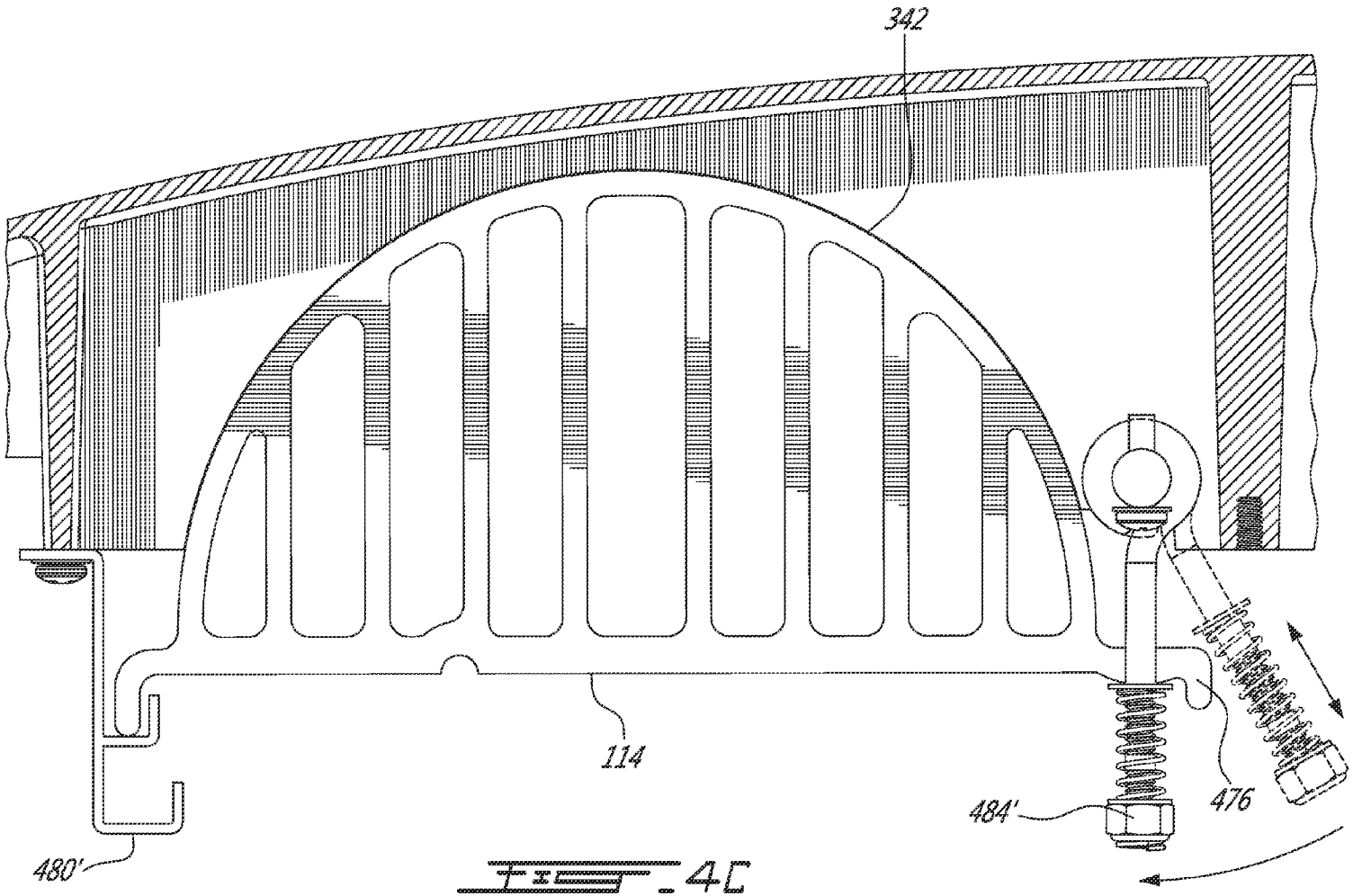
Figure 4D:
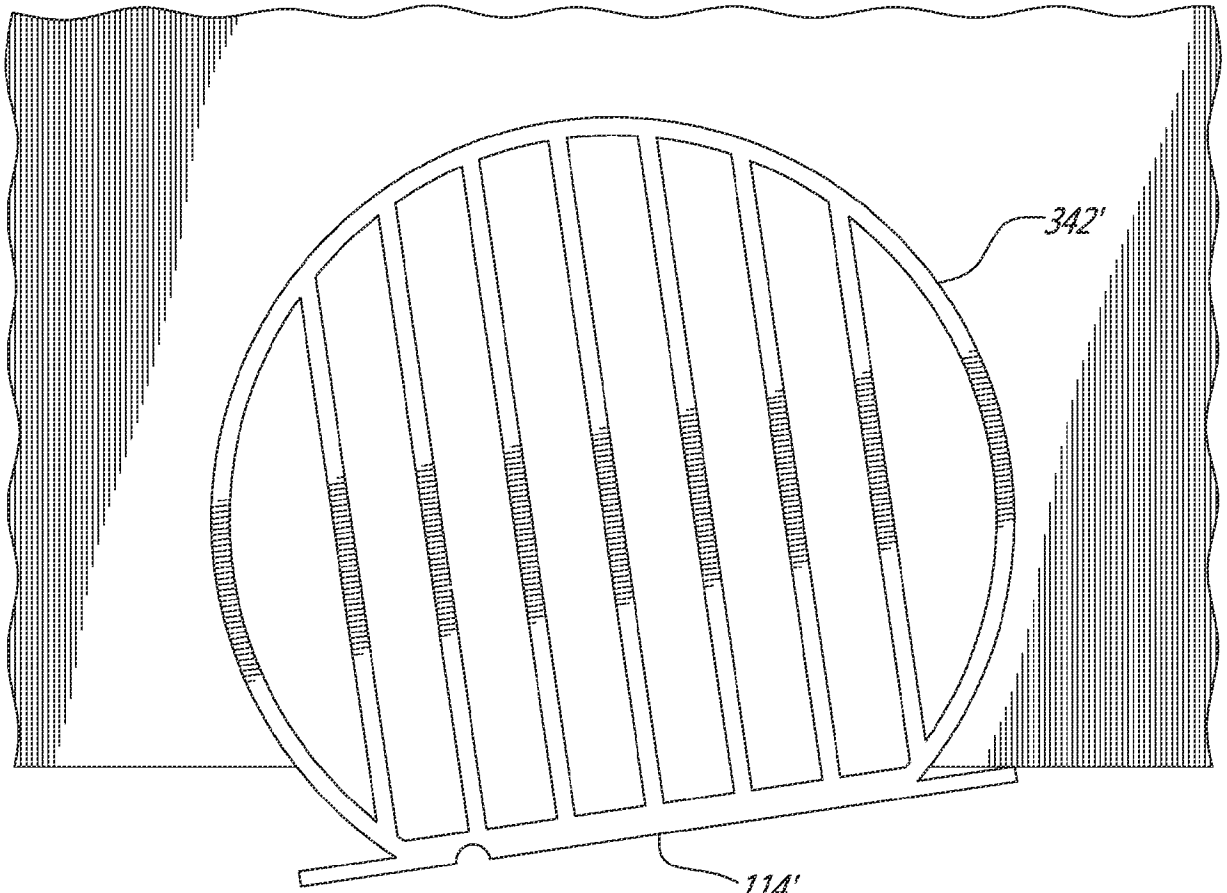

FIG. 3 shows an exemplary exploded perspective view of a lamppost head assembly 300 in accordance with the teachings of the present invention. The lamppost head assembly 300 is shown with a housing compartment 305 of a capacity of 4 lighting panel assemblies 180. To better illustrate the present invention, two lighting panel assemblies 180 are shown in two cavities 312 and 322, cavity 332 is shown empty while only a heat sink 114 is shown in cavity 342. The two cavities 312-322 or the two cavities 332-342, in the configuration shown on FIG. 3, could each be considered as a single cavity. Two panels similar to the panel 110 could also be fixed to a single, larger heat sink (not shown) to fit into the single cavity.

In the example of FIG. 3, the cavities 312-322-332-342 are semi circular in shape and define a channel. Each exemplary channel is perpendicular to a longitudinal axis of the housing compartment 305 and is formed by multiple fins that extend within the housing compartment 305. An exemplary contact surface 334 formed the multiple fins of the cavity 332 is shown. The surface 334 receives heat from the heat sink 114 (e.g., via a thermal bridge). A continuous contact surface (not shown) could also be provided to receive a heat sink that exposes fins thereto (not shown in FIG. 3).

FIG. 4A, FIG. 4B, FIG. 4C and FIG. 4D are herein referred to concurrently as FIG. 4. Reference is made concurrently to FIG. 3 and FIG. 4, which shows a side view of the heat sink 114 and the cavity 342. The heat sink 114 has a complementary curved shape adapted to fit into the cavity 342. The channel of the cavity 342 may be defined by an arc of x degrees in a circle with a radius r. In such an example, the heat sink 114 would be defined by an arc of y degrees in a circle with a radius r', with y larger than x and r substantially equal to r', within expected tolerances or with r' slightly smaller than r to ensure easier fit without compromising heat transfer. Persons skilled in the art will readily be able to determined proper values of r, r' and other dimensions of the different components to fit different needs. The difference between y and x defines a potential rotational angle of the heat sink 114 within the cavity 342 versus the housing compartment 305. Since the panel 110 is attached to the heat sink 114, the angle between the heat sink 114 and the housing compartment 305 are linked. When the panel 110 is parallel to the heat sink 114, both angles are equal. A fixed angle between the heat sink 114 and the panel 110 could also be used. Maintaining the angle between the heat sink 114 and the housing compartment 305 also maintains the angle between the panel 110 and the housing compartment 305, no matter if the panel 110 and the heat sink 114 are parallel or not. The angle between the panel 110 and the housing compartment 305 determines the angle at which a light beam is projected away from the housing compartment 305. Hence, the angle between the panel 110 and the housing compartment 305 also determines a distance at which a light beam from the panel 110 is projected away from a mounting point of the housing compartment 305.

The circular or semi-circular shape allows for an infinite number of choices as to the angle between the panel 110 and the housing compartment 305. In order to fix the value of the rotational angle between the heat sink 114 and the housing compartment 305 (e.g., to a value A), a fastener such as a bracket 480 can be used. The height h of the bracket 480 will allow to maintain the heat sink 114 at the desired rotational angle A. On the example of FIG. 4, one end of the exemplary bracket 480 is shown with a gutter adapted to fit an extending lip 478 of the heat sink 114. Once the bracket 480 is fixed onto the housing compartment 305 (e.g., using a screw 482), another fastener such as screw 484 can be used to secure a ledge 476 of the heat sink 114 in place. Skilled reader will recognize that length of the screw 484 has to take into account the height of the bracket 480. The bracket 480 on the lip 478 and the screws 482-484 maintain the heat sink 114 at the desired rotational angle A and also maintain the heat sink 114 within the cavity 342. It should be noted that the bracket 480 could be long enough to maintain two or more parallel heat sinks in their respective cavities maintaining the same angle for all heat sinks. A bracket 480' presenting more than one gutters could also be used to provide multiple choices of angles at once. The bracket 480' may be of variable length to maintain a single heat sink or a number of parallel heat sinks.

The torque applied to the exemplary screws 482 and 484 needs to be determined to maintain necessary contact between the heat sink 114 and the cavity 342 to ensure expected heat dissipation. Alternatively, a rotatable spring loaded screw 484' could also be used to maintain the heat sink 114 in the cavity 342. The spring loaded screw 484' is rotatably attached to the housing compartment 305. Once put in place over the ledge 476, the spring loaded screw 484' is released. The spring loaded screw 484' provides an exemplary advantage of maintaining a constant pressure over the heat sink 114 to ensure expected thermal bridge towards the housing compartment 305 and is expected to do so over a longer period of time when compared to the screw 484.

Alternatively, a cavity 342' could be defined by a semi-circular shape that has more than 180 degrees. A heat sink 114' could thereby be maintained in the cavity 342' by the cavity 342' itself. The heat sink 114' could be inserted sideways into the cavity 342' or the cavity 342' could be formed by more than one part (not shown) closed over the heat sink 114'.

Persons skilled in the art will readily determine proper dimensioning of the screws 482, 484 and 484' as well as material used for the screws and the housing compartment 305 in view of the desired heat transfer results. Bushings, spacers or the like could be used, for instance, between the heat sink 114 (e.g., the ledge 476 and/or the extending lip 478) and the housing compartment 305. For instance, a spacer of length determined by the height h of the bracket 480 could be used on the screw 484, between the ledge 476 and the housing compartment 305, thereby providing a guide toward proper torque and reducing the risk of striping the screw 484 and/or the screw hole. It is expected that common aluminum alloy will be used to cast the housing compartment 305 in a single piece also defining the cavities, which may further be milled or machined in preparation for final use (e.g., preparing pre-holes for the various screws, preparing surfaces of the cavities for thermal bridge, etc.). The heat sink 114 is also expected to be made of aluminum or aluminum alloy in a single piece. Persons skilled in the art will recognize that other configuration than a one-piece cast housing compartment 305 and/or heat sink 114 can also be suited for the intended purpose.

Figure 5:
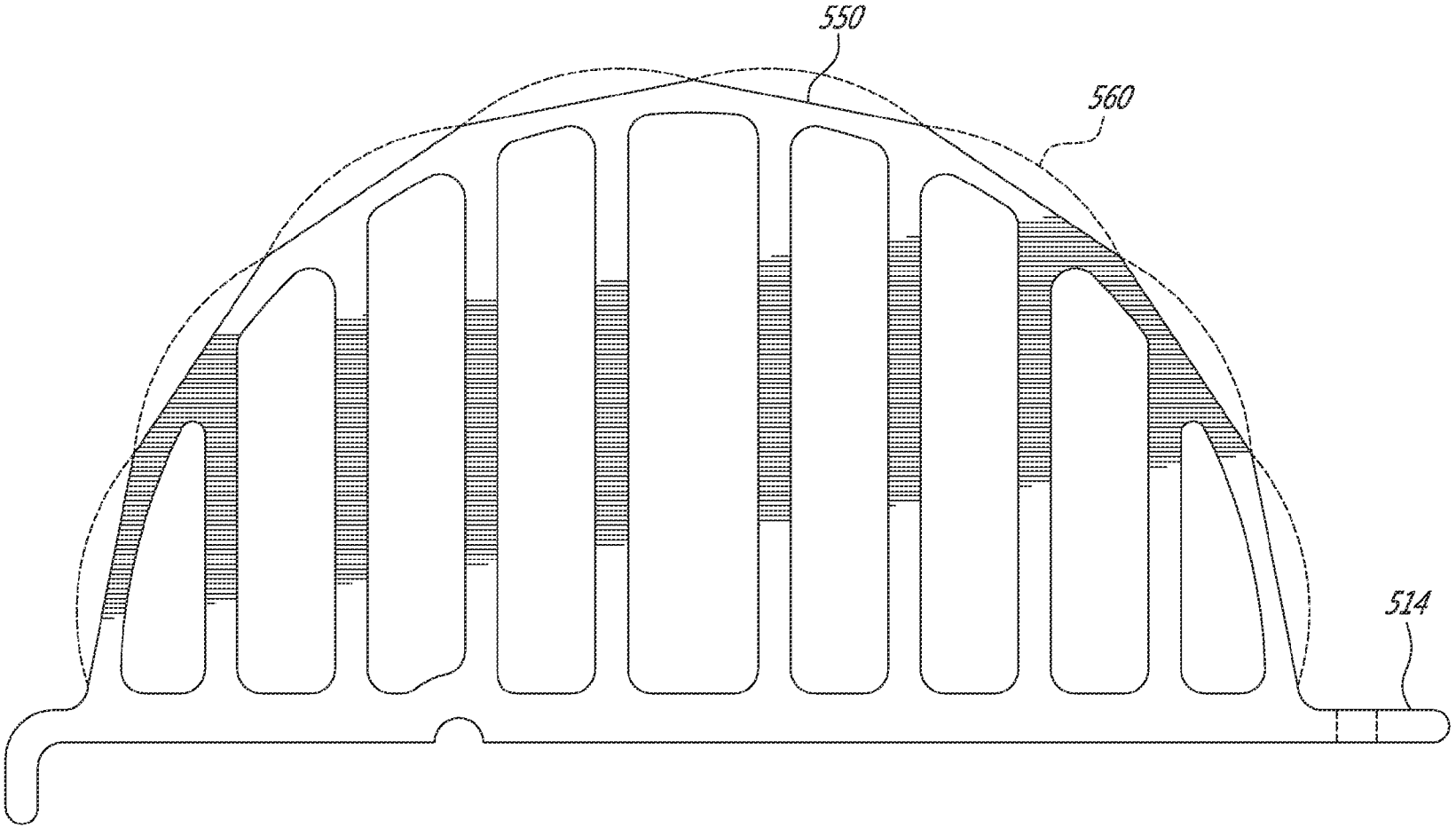
FIG. 5 is a side view of an exemplary facetted heat sink in accordance with the teachings of the present invention.

FIG. 5 shows a side view of an exemplary facetted heat sink 514 in accordance with the teachings of the present invention. FIG. 5 shows a first facetted configuration with multiple straight panels 550 forming a facetted surface 594. FIG. 5 also shows a second facetted configuration with multiple curved panels 560 forming the facetted surface 594. The curved panels 560 are shown convex, but a concave configuration (not shown) could also be used. Based on the shape of the heat sink 514, a cavity of the housing compartment also needs to be correspondingly made to receive the heat sink 514 so as to allow heat dissipation from the heat sink 514 into the housing compartment. Skilled reader will readily recognize that the number of surfaces 550 and 560 shown is chosen for clarity and that a larger (or smaller) number of surfaces could be chosen. The number of surfaces determines the number of choices given for angle adjustment. A mix of straight panel(s) and curved panel(s) could also be used, for instance, in order to further limit the number of choices given for angle adjustments. A cavity configured to receive a single straight or curved panel combined with different heat sink configurations that provide a single straight or curved panel at different positions could allow off-site determination of the angle and thereby ensure unique and proper positioning on-site.

The heat sink 514 also shows exemplary fins 592 extending towards the surface 594, some of them not extending all the way through. The exemplary fins' 592 configuration and the facetted surfaces 560 and 550 are optional features that could be used together or independently.

Figure 6:
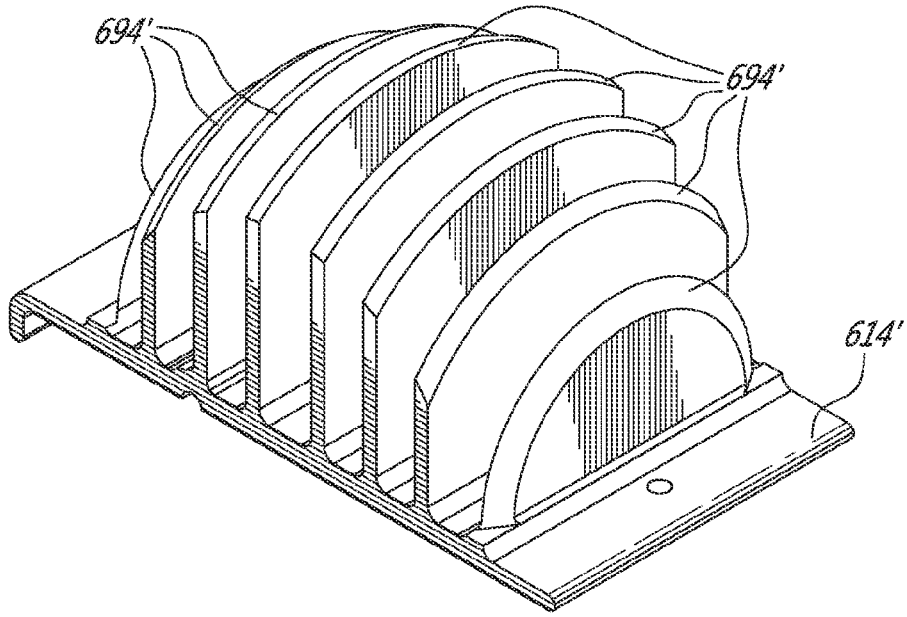
FIG. 6 is a perspective view of exemplary heat sinks having hemispherical shape in accordance with the teachings of the present invention.
Figure 6:
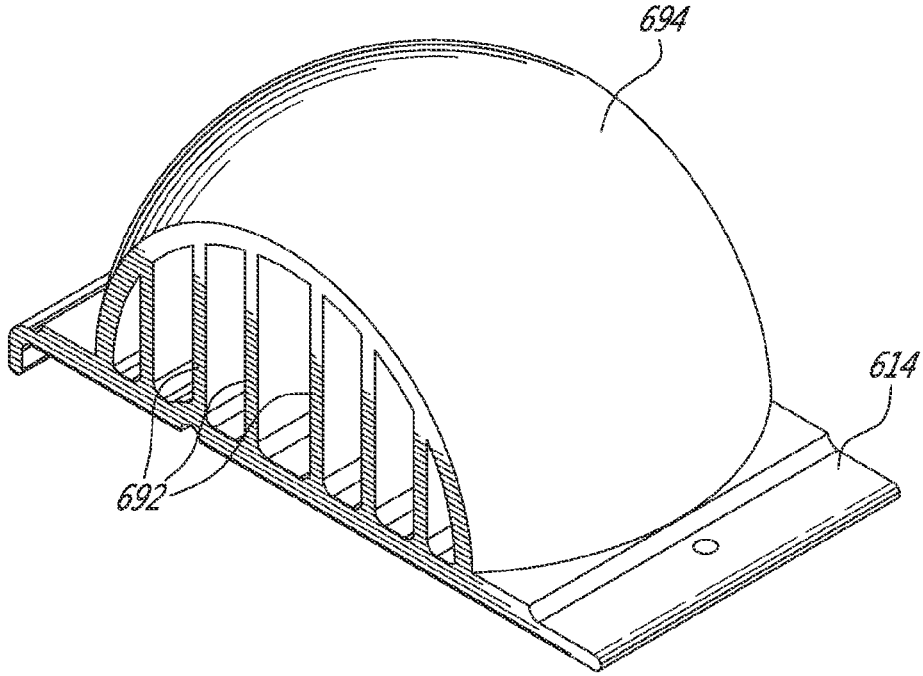

FIG. 6 shows a perspective view of exemplary heat sinks 614 and 614' having hemispherical shape in accordance with the teachings of the present invention. In such an exemplary configuration, the angle between a panel and a housing compartment could be determined in many directions. The heat sinks 614 and 614' show a partial hemispherical shape, but skilled reader will readily recognize that other options are possible. The heat sink 614 is shown with a continuous surface 694, which could make fins 692 difficult to obtain. The heat sink 614' is shown with a discontinuous surface 694', which would require a different configuration of a receiving cavity (e.g., continuous or partly continuous surface to ensure heat transfer).

Figure 7:
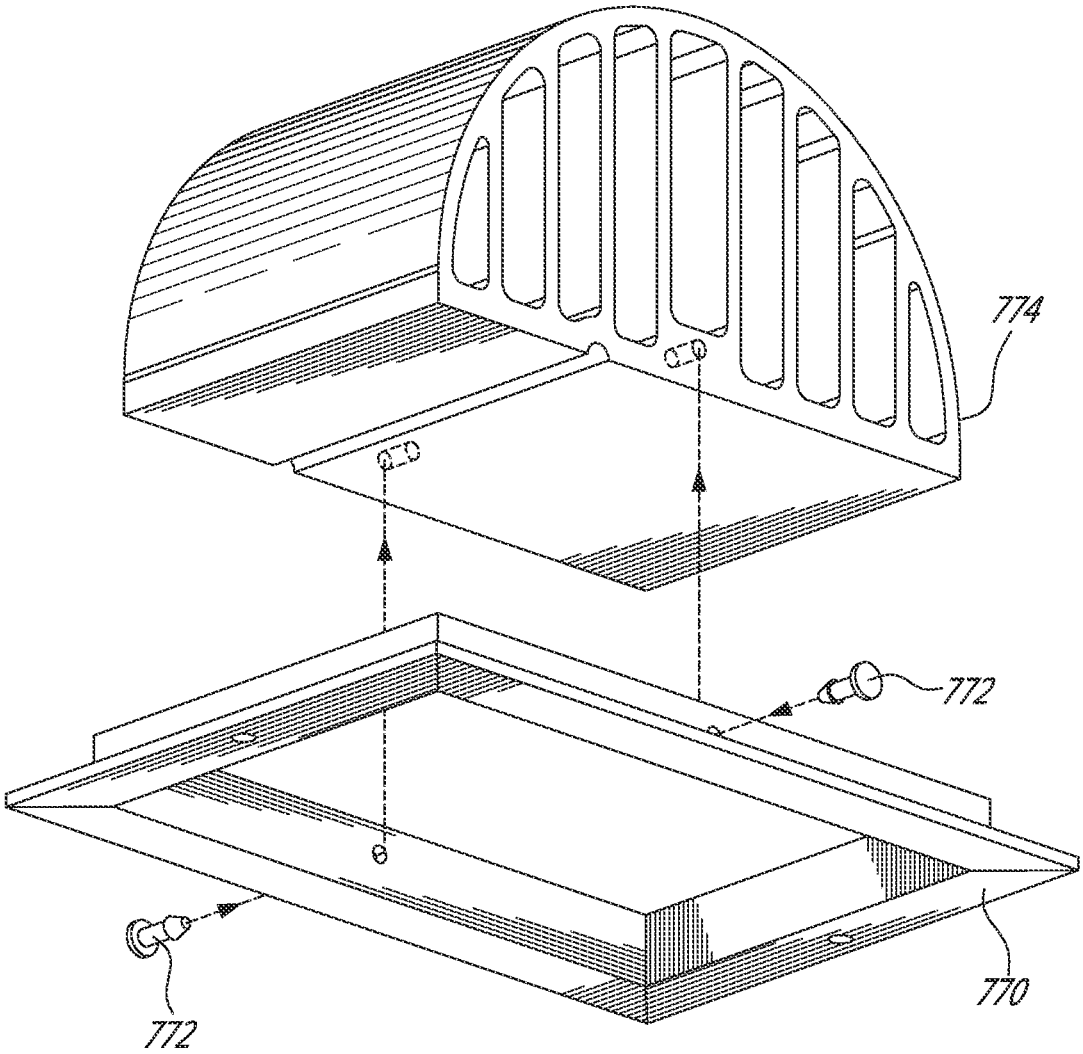
FIG. 7 is a perspective view of an exemplary panel frame and heat sink in accordance with the teachings of the present invention.

FIG. 7 shows a perspective view of an exemplary panel frame 770 and heat sink 714 in accordance with the teachings of the present invention. The heat sink can be rotatably attached to the panel frame 770 through pegs 772 or other means. The panel frame 770 can then be fixed to the housing compartment (screws or press fit design) Alternatively, the panel or panel cover (not shown on FIG. 7) instead of the heat sink 714 could be rotatably attached to the panel frame 770. Another fastener (not shown) could be used between the panel, the cover or the heat sink 714 and the panel frame 770 to maintain the angle between the panel and the housing compartment. This configuration would allow off-site angle determination and predictable on-site installation. Alternatively, the heat sink 714 and its receiving cavity may be adapted to maintain the angle (friction alone, pegs and holes, complementary shapes, etc.). This configuration may allow on-site angle determination for greater flexibility.

Figure 8:
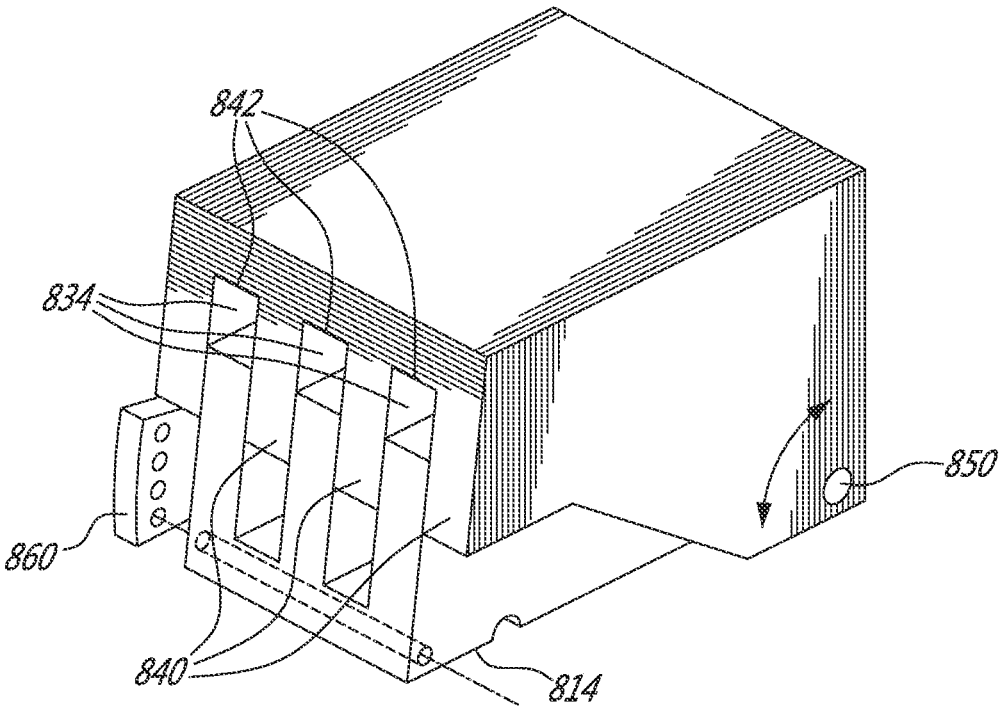
FIG. 8 is a perspective view of an exemplary complementary heat sink cavity and panel heat sink in accordance with the teachings of the present invention.

FIG. 8 shows a perspective view of an exemplary complementary heat sink cavity 842 of a housing compartment and a heat sink 814 in accordance with the teachings of the present invention. A LED panel (not shown) is meant to be maintained to the heat sink 814. The cavity 842 is defined by a plurality of heat sinks fins 840 extending outwardly. The plurality of heat sinks fins 840 define a surface 834 that receives heat from the heat sink 814 (e.g., via a thermal bridge). The heat sink 814 could be in contact with the surface 834 on both sides of its fins (as shown) or on only one side (not shown). Persons skilled in the art will be able to determine the required contact surface 834 based on the heat dissipation need. In the example of FIG. 8, a pivot point 850 receives a peg or other fastener (not shown) to allow the heat sink 814 to rotate in the cavity 842. The heat sink fins 840 are shaped so as to allow the heat sink 814 to enter into the cavity 842 to provide a plurality of angle options. While the pivot point 850 is shown eccentric to the heat sink 814, it could also be located in any other location (e.g., the center), which would require defining a different shape of cavity 842 via the heat sink fins 840. Another fastener (not shown) could be used between the heat sink 814 and the cavity 842 to maintain the angle between the panel and the housing compartment. This other fastener could simply be friction between the contact surface 834 and the heat sink 814. Another exemplary alternative is to have one or more wings extending towards the heat sink fins 840 (not shown) or from a cover (not shown) 860 to receive. A peg (not shown) may be used through the heat sink 814 and the wing 860, screws (not shown) or complementary shapes from the heat sink 814 (not shown) may also be used as a fastener. The one or more wings could be located parallel or perpendicular to the longitudinal axis of the heat sink 814, in which case the wing will be curved to follow the heat sink 814 during rotation.

Skilled reader will appreciate that different fasteners could be used to fix, maintain or secure parts together without affecting the present invention, such as screws, screws and bolts, rivets, nails, pins, piston pins, brackets, cramps, clamps, braces, buckles, hooks, clips, clasps, snaps, press fit mounting, retaining rings, pegs and holes, zippers, tacks, etc.

The description of the present invention has been presented for purposes of illustration but is not intended to be exhaustive or limited to the disclosed embodiments. Many modifications and variations will be apparent to those of ordinary skill in the art. The embodiments were chosen to explain the principles of the invention and its practical applications and to enable others of ordinary skill in the art to understand the invention in order to implement various embodiments with various modifications as might be suited to other contemplated uses.

What is claimed is:

1. A lamppost head assembly comprising:

a housing compartment having a cavity;

a panel having a plurality of Light Emitting Diodes (LEDs) positioned on a first surface and a heat sink positioned on a second surface opposite to the first surface, wherein the heat sink is adapted to fit into the cavity for dissipating the panel's heat into the housing compartment; and at least one fastener that maintains the panel at an angle with the housing compartment from a plurality of angle options, wherein the heat sink comprises an extending lip positioned at one end and a ledge at the other end, wherein the at least one fastener comprises:

a first fastener that fixes the ledge to the housing compartment; and a bracket fixed to the housing compartment that holds to the heat sink lip, the height of the bracket determining the angle.

2. The lamppost head assembly of claim 1, wherein the at least one fastener further maintains the heat sink into the cavity.

3. The lamppost head assembly of claim 1, wherein the heat sink has a continuous surface formed by multiple fins and in contact with the cavity.

4. The lamppost head assembly of claim 1, wherein the cavity has a continuous surface formed by multiple fins and in contact with the heat sink.

5. The lamppost head assembly of claim 1, wherein the angle determines a distance at which a light beam from the panel is projected away from a mounting point of the housing compartment.

6. The lamppost head assembly of claim 1, wherein the cavity has a hemispherical socket shape and wherein the hemispherical socket shape is continuous.

7. The lamppost head assembly of claim 1 further comprising:

a second panel having a second plurality of Light Emitting Diodes (LEDs) positioned on a first surface of the second panel and the heat sink positioned on a second surface of the second panel opposite to the first surface of the second panel, wherein the at least one fastener further maintains the second panel at the angle.

8. The lamppost head assembly of claim 1, wherein the first fastener is a spring loaded screw rotatably attached to the housing compartment.

9. The lamppost head assembly of claim 1, wherein the heat sink is cast in a single metallic piece and wherein the housing compartment and the cavity are cast in a single metallic piece.

10. The lamppost head assembly of claim 1, wherein the cavity has a semicircular channel shape.

11. The lamppost head assembly of claim 10, wherein the semicircular channel shape is positioned perpendicularly from a longitudinal axis of the housing compartment and wherein the angle determines a distance at which a beam of light from the panel is projected away from a mounting point of the housing compartment.

12. The lamppost head assembly of claim 10, wherein the semicircular channel shape defines a plurality of surfaces or wherein the semicircular channel shape is continuous.

13. The lamppost head assembly of claim 1, wherein the panel can rotate within a panel frame and the at least one fastener comprises at least a first fastener that fixes the panel frame to the housing compartment thereby maintaining the heat sink in the cavity.

14. The lamppost head assembly of claim 13, wherein the at least one fastener comprises at least a second fastener between the panel and the panel frame that maintains the angle.

15. The lamppost head assembly of claim 13, wherein the at least one fastener comprises at least a second fastener between the heat sink and the cavity that maintains the angle.

16. The lamppost head assembly of claim 1 further comprising:

a second panel having a second plurality of Light Emitting Diodes (LEDs) positioned on a first surface of the second panel and a second heat sink positioned on a second surface of the second panel opposite to the first surface of the second panel.

17. The lamppost head assembly of claim 16, wherein the second heat sink is adapted to fit into the cavity for dissipating the second panel's heat into the housing compartment and wherein the at least one fastener further maintains the second panel at the angle and maintains the second heat sink into the cavity.

18. The lamppost head assembly of claim 16, wherein the second heat sink is adapted to fit into a second cavity of the lamppost head assembly for dissipating the second panel's heat into the housing compartment and wherein the at least one fastener comprises at least a first fastener that maintains the panel at the angle and a second fastener that maintains the second panel at a second angle from the pluralities of angle options.

19. The lamppost head assembly of claim 18, wherein the angle and the second angle are substantially equal.

* * * * *